US010487498B2

(12) United States Patent
Hagiwara et al.

(10) Patent No.: US 10,487,498 B2
(45) Date of Patent: Nov. 26, 2019

(54) FLEXIBLE PRINTED CIRCUIT BOARD STRUCTURE AND INDOOR PARTITION WALL

(71) Applicants: NIHON DENGYO KOSAKU CO., LTD., Tokyo (JP); KDDI CORPORATION, Tokyo (JP)

(72) Inventors: Hiroki Hagiwara, Tokyo (JP); Akira Maruyama, Tokyo (JP); Kazuhiro Gosui, Tokyo (JP); Katsuyoshi Hoshino, Tokyo (JP); Yoko Kurosawa, Tokyo (JP)

(73) Assignees: NIHON DENGYO KOSAKU CO., LTD., Chiyoda-shi, Tolyo (JP); KDDI CORPORATION, Shinjuku-ku, Tokyo (JP)

( * ) Notice: Subject to any disclaimer, the term of this patent is extended or adjusted under 35 U.S.C. 154(b) by 0 days.

(21) Appl. No.: 16/088,515

(22) PCT Filed: Feb. 16, 2017

(86) PCT No.: PCT/JP2017/005701
§ 371 (c)(1),
(2) Date: Sep. 26, 2018

(87) PCT Pub. No.: WO2017/169248
PCT Pub. Date: Oct. 5, 2017

(65) Prior Publication Data

US 2019/0112806 A1 Apr. 18, 2019

(30) Foreign Application Priority Data

Mar. 28, 2016 (JP) ..... 2016-064730

(51) Int. Cl.
*E04B 2/74* (2006.01)
*H01Q 1/38* (2006.01)
(Continued)

(52) U.S. Cl.
CPC ..... *E04B 2/74* (2013.01); *H01Q 1/38* (2013.01); *H01Q 1/44* (2013.01); *H01Q 1/50* (2013.01); *E04B 2002/7488* (2013.01)

(58) Field of Classification Search
USPC ..... 361/749
See application file for complete search history.

(56) References Cited

U.S. PATENT DOCUMENTS 4,987,424 A 1/1991 Tamura et al.
5,842,873 A 12/1998 Gonzales
(Continued)

FOREIGN PATENT DOCUMENTS

EP 2148388 A1 1/2010
JP 63-254804 A 10/1988
(Continued)

OTHER PUBLICATIONS

Notification of Reasons for Refusal for Japanese Application 2016-064730 dated Sep. 12, 2017.
(Continued)

*Primary Examiner* — Andargie M Aychillhum
(74) *Attorney, Agent, or Firm* — Sughrue Mion, PLLC

(57) ABSTRACT

A film antenna 1 to which the present invention is applied includes: an antenna part 10 in which a dual-frequency antenna 12*a* and an antenna GND section 12*b* are formed; a feeding board 21 to which a coaxial cable 30 for feeding the antenna part 10 is connected; and a pressing member 23 which, together with the feeding board 21, sandwiches a contact point 13, coated with silver paste 22, of the antenna part 10, and electrically connects the contact point 13 and the feeding board 21 to one another.

6 Claims, 8 Drawing Sheets

(51) Int. Cl.
*H01Q 1/44* (2006.01)
*H01Q 1/50* (2006.01)

(56) References Cited

U.S. PATENT DOCUMENTS

| | | | | |
|---|---|---|---|---|
| 6,798,383 | B2 | 9/2004 | Nakase et al. | |
| 9,178,273 | B2 * | 11/2015 | Mikami | H01Q 1/36 |
| 2010/0090787 | A1 | 4/2010 | Kuramoto | |
| 2011/0227808 | A1 | 9/2011 | Takano et al. | |
| 2016/0043473 | A1 | 2/2016 | Walker | |
| 2016/0282386 | A1 * | 9/2016 | Nagata | G01R 1/0466 |

FOREIGN PATENT DOCUMENTS

| | | | |
|---|---|---|---|
| JP | 64-049302 | A | 2/1989 |
| JP | 4-55810 | U | 5/1992 |
| JP | 7-33452 | U | 7/1995 |
| JP | 9-238012 | A | 9/1997 |
| JP | 2005-080074 | A | 3/2005 |
| JP | 2006-287729 | A | 10/2006 |
| JP | 2008-187383 | A | 8/2008 |
| JP | 2010-034924 | A | 2/2010 |
| JP | 2011-091556 | A | 5/2011 |
| JP | 2012-113840 | A | 6/2012 |
| JP | 2013-255094 | A | 12/2013 |

OTHER PUBLICATIONS

International Search Report for PCT/JP2017/005701 dated May 16, 2017 [PCT/ISA/210].
EESR (Extended European Search Report) dated Oct. 14, 2019, for EP Application 17773796.2.

* cited by examiner

FLEXIBLE PRINTED CIRCUIT BOARD STRUCTURE AND INDOOR PARTITION WALL

CROSS REFERENCE TO RELATED APPLICATIONS

This application is a National Stage of International Application No. PCT/JP2017/005701 filed Feb. 16, 2017, claiming priority based on Japanese Patent Application No. 2016-064730 filed Mar. 28, 2016.

TECHNICAL FIELD

The present invention relates to a flexible printed circuit board structure and an indoor partition wall.

BACKGROUND ART

In Patent Document 1, for providing a transparent antenna, which is a sheet-like flat antenna not to be recognized as an antenna at first glance, and is able to satisfy performance as an antenna, there is suggested a transparent antenna that realizes transparency close to transparency of a base material by forming an antenna pattern by laminating a conducting material on a surface of a transparent or substantially transparent sheet-like base material, and increasing an aperture ratio thereof to 70% to 75% in an area ratio with a large number of fine transparent pores of the order of the pore diameter from 400μ to 500μ and the line width of 80μ.

CITATION LIST

Patent Literature

Patent Document 1: Japanese Examined Utility Model Application Publication No. 7-33452

SUMMARY OF INVENTION

Technical Problem

In a visible light transmissive antenna made of a resin film, which is one of flexible printed circuit boards capable of forming a high-frequency circuit thereon, since heat resistance of the film was low, for example, it was impossible to perform feeding by soldering. Therefore, a feeding structure having conduction by use of a conductive adhesive or a conductive double-faced tape at the contact point was adopted in general; however, when such a feeding structure was adopted, contact at the contact point became instable, and there occurred deterioration in PIM (Passive Inter Modulation) characteristics.

On the other hand, in recent years, requests to use a visible light transmissive antenna using a resin film performing transmission and reception at two or more different frequencies have been made. However, it was impossible to obtain preferable PIM characteristics by conventional feeding structures, and there was a difficult situation to respond to such requests.

A main object of the present invention is to stabilize the PIM characteristics with a flexible printed circuit board having the high-frequency circuit formed thereon, which is typified by, for example, a visible light transmissive antenna made of a resin film.

Solution to Problem

The invention described in claim 1 is a flexible printed circuit board structure including: a flexible printed circuit board on which a high-frequency circuit is formed; a feeding board to which a cable or a connector for feeding the flexible printed circuit board is connected; and a pressing member that sandwiches a contact point of the flexible printed circuit board and the feeding board together, and presses the contact point and the feeding board to electrically connect the contact point and the feeding board, wherein a through hole is formed at the contact point of the flexible printed circuit board, and the pressing member presses the contact point and the feeding board with a fastening tool by use of the through hole.

The invention described in claim 2 is a flexible printed circuit board structure including: a flexible printed circuit board that includes a projecting location projecting toward another portion and a high-frequency circuit formed on the flexible printed circuit board; a feeding board that includes an antenna feeding section to which a cable or a connector for feeding the flexible printed circuit board is connected and a ground section insulated from the antenna feeding section; and a pressing member that sandwiches an antenna contact point and a ground contact point as a contact point provided to the projecting location of the flexible printed circuit board together with the feeding board, presses the antenna contact point and the antenna feeding section of the feeding board with a fastening tool, and presses the ground contact point and the ground section of the feeding board with another fastening tool to attain electrical connection.

The invention described in claim 3 is the flexible printed circuit board structure according to claim 1, wherein a conductive material is interposed between the contact point and the feeding board, the flexible printed circuit board is an antenna using a resin film, and the cable or the connector is connected to the feeding board by soldering.

The invention described in claim 4 is the flexible printed circuit board structure according to claim 2, wherein a conductive material is interposed between the contact point and the feeding board, the flexible printed circuit board is an antenna using a resin film, and the cable or the connector is connected to the feeding board by soldering.

The invention described in claim 5 is an indoor partition wall including: a partition material that is formed of a film material or a plate material to partition a space in a room; an antenna that is formed on one or both surfaces of the partition material and connected to any one of end portions of the partition material; and a feeding part that is provided along the end portion of the partition material, to which a cable or a connector for feeding the antenna is connected, wherein the feeding part includes a feeding board to which the cable or the connector is connected and a pressing member that presses a contact point of the antenna and the feeding board to electrically connect the contact point of the antenna and the feeding board, a through hole is formed at the contact point of the antenna, and the pressing member sandwiches the contact point and the feeding board together by use of the through hole and presses the contact point and the feeding board with a fastening tool.

The invention described in claim 6 is an indoor partition wall including: a partition material that includes a projecting location projecting toward another portion, the partition material being formed of a film material or a plate material to partition a space in a room; an antenna that is formed on one or both surfaces of the partition material and is connected to the projecting location of the partition material;

and a feeding part that is provided along the projecting location of the partition material and includes an antenna feeding section for feeding the antenna, to which a cable or a connector is connected, and a ground section insulated from the antenna feeding section, wherein an antenna contact point and a ground contact point provided to the projecting location of the partition material are sandwiched together with the feeding part by a pressing member, the antenna contact point and the antenna feeding section of the feeding part are pressed with a fastening tool, and the ground contact point and the ground section of the feeding part are pressed with another fastening tool to attain electrical connection.

Advantageous Effects of Invention

According to the invention of claim 1, it is possible to stabilize electrical connection between the flexible printed circuit board and the cable or the connector, and to reduce deterioration of the PIM characteristics.

According to the invention of claim 2, it is possible to further stabilize the electrical connection between the flexible printed circuit board and the cable or the connector.

According to the invention of claim 3, even when soldering is carried out onto the feeding board, heat generated in the course of soldering is not transmitted to the resin film, and therefore, no problem of overheating occurs.

According to the invention of claim 4, when the antenna device is installed indoors, it is possible to reduce spoilage of the indoor sights.

According to the invention of claim 5, it is possible to provide the antenna device indoors that stabilizes the electrical connection between the flexible printed circuit board and the cable or the connector.

DESCRIPTION OF EMBODIMENTS

First Exemplary Embodiment

Hereinafter, an exemplary embodiment according to the present invention will be described in detail with reference to attached drawings.

Figure 1:
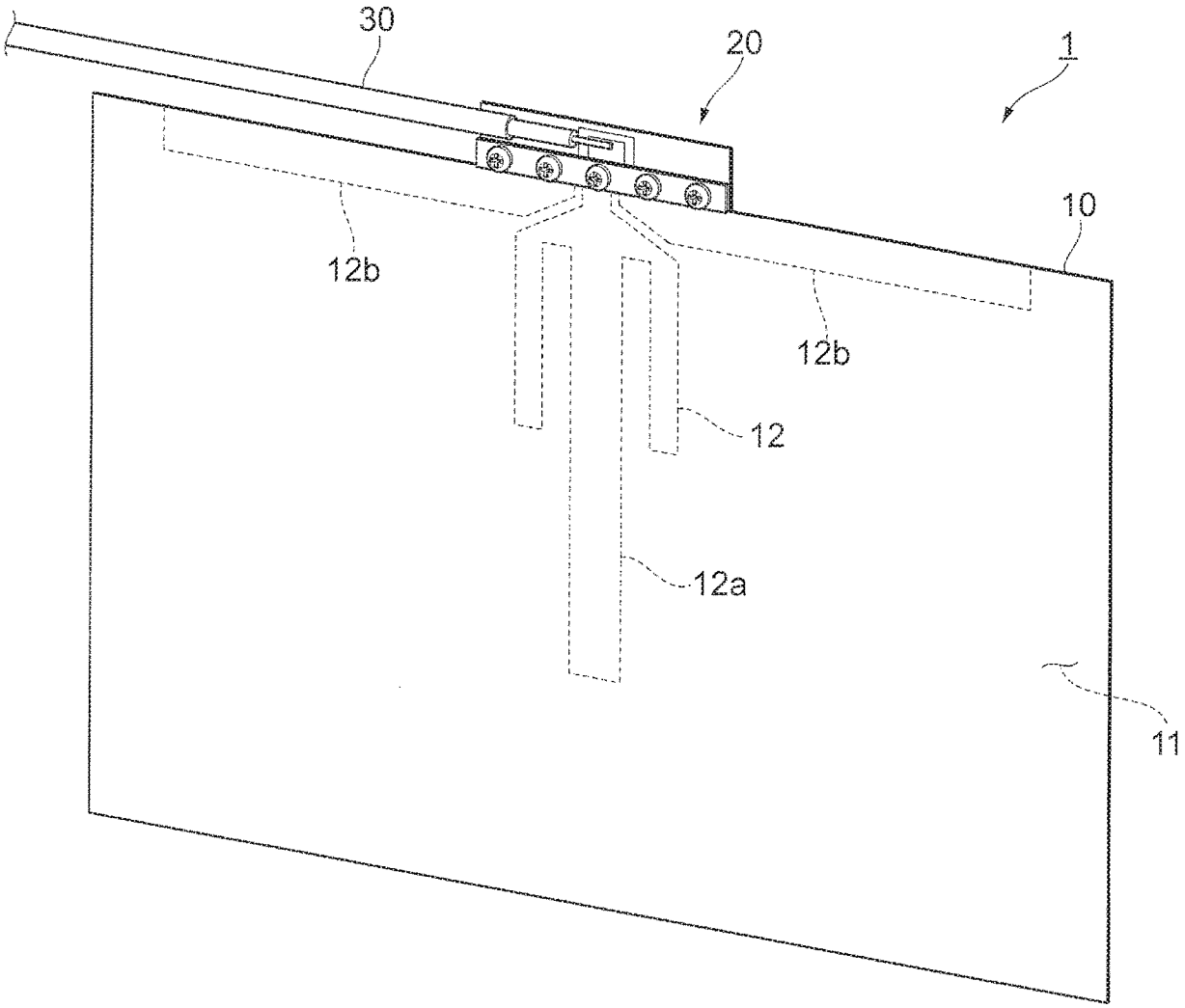
FIG. 1 shows a configuration of a film antenna to which the exemplary embodiment is applied.

FIG. 1 shows a configuration of a film antenna 1 to which the exemplary embodiment is applied.

The film antenna 1 to which the exemplary embodiment is applied functions as one of flexible printed circuit board structures. Then, the film antenna 1 to which the exemplary embodiment is applied includes: an antenna part 10 that is one of flexible printed circuit boards on which a high-frequency circuit is formed; and a feeding part 20 to which a coaxial cable 30 for feeding the antenna part 10 is connected. In the antenna part 10, in a film 11 made of a transparent resin material having high light transmittance, such as, for example, PET (Poly Ethylene Terephthalate) resin, an antenna 12 using a transparent conductive material having high light transmittance is formed. The antenna 12 includes a dual-frequency antenna 12*a* that uses two frequencies of, for example, the 800 MHz band and the 2.1 GHz band, and an antenna GND section 12*b* to be connected to the ground (GND). Note that, as the high-frequency circuit, a feeding circuit or a distribution circuit can be provided other than the antenna, and the flexible printed circuit board structure of the exemplary embodiment can be applied to a circuit board including these circuits.

Figure 2:
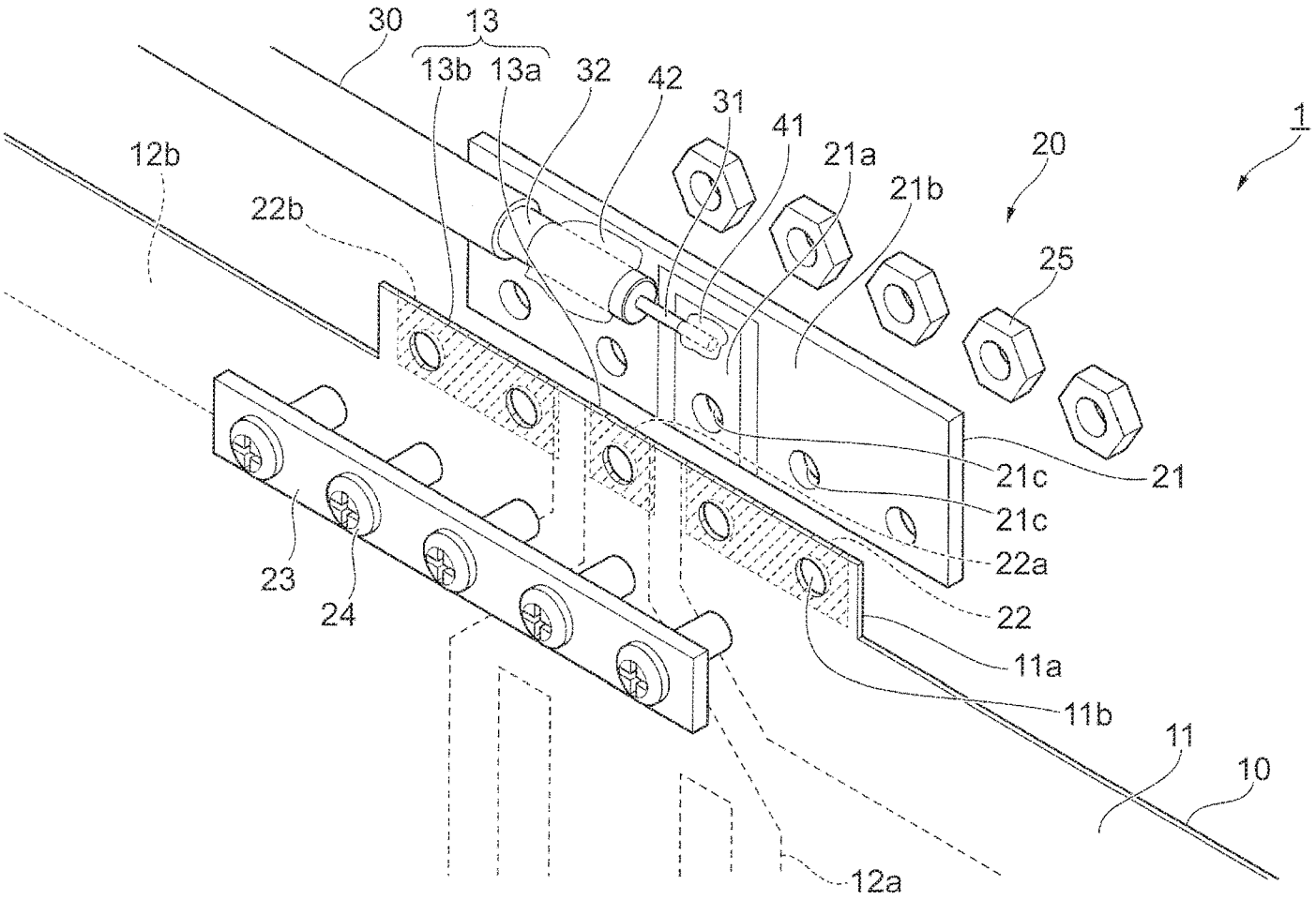
FIG. 2 is a diagram for illustrating a feeding part of the film antenna to which the exemplary embodiment is applied.

FIG. 2 is a diagram for illustrating the feeding part 20 of the film antenna 1 to which the exemplary embodiment is applied. The feeding part 20 includes: a feeding board 21 to which the coaxial cable 30 is connected; and a pressing member 23 that presses a contact point 13 of the antenna part 10 against the feeding board 21. Moreover, the feeding part 20 is provided with male screws (vises) 24 and female screws (nuts) 25. The pressing member 23 sandwiches a region of the antenna part 10 including the contact point 13 (a projecting location 11*a* formed on one end portion of the film 11 (an upper portion in FIG. 2)) with the feeding board 21, to thereby electrically connect the contact point 13 and the feeding board 21. More specifically, the pressing member 23 is provided with plural through holes for pressing the contact point 13 in the antenna part 10 and the feeding board 21 by use of the male screws (vises) 24 and the female screws (nuts) 25, to thereby electrically connect the contact point 13 in the antenna part 10 and the feeding board 21.

The contact point 13 is formed, in the projecting location 11*a* of the film 11, on a surface on the side facing the feeding board 21 (in FIG. 2, backside of the projecting location 11*a*). The contact point 13 of the antenna part 10 is provided with an antenna contact point 13*a* having conduction to the dual-frequency antenna 12*a* of the antenna 12 and GND contact points 13*b* having conduction to the antenna GND section 12*b* of the antenna 12. Moreover, the projecting location 11*a* of the film 11 is provided with through holes 11*b* through which the male screws (vises) 24 penetrate. The through holes 11*b* are provided corresponding to formation locations of the antenna contact point 13*a* and the GND contact points 13*b*; in the example shown in FIG. 2, one through hole 11*b* is provided at the position corresponding to the antenna contact point 13*a* and four through holes 11*b* are provided at the positions corresponding to the GND contact points 13*b* (two through holes on each of the right and left across the position of the antenna contact point 13*a*). Note that the number of through holes 11*b* is not limited to the above-described number. The number of through holes 11*b* may be suited to the size of the antenna contact point 13*a* and the GND contact points 13*b*; when the antenna contact point 13*a* and the GND contact points 13*b* are small, at least one through hole 11*b* is required, but when the antenna contact point 13*a* and the GND contact points 13*b* are large, three or more through holes 11*b* may be provided.

The feeding board 21 include patterns formed of, for example, copper on a surface facing the contact point 13 of the antenna part 10, which is on a circuit board of a glass-epoxy material, such as FR-4 (Flame Retardant-4) or CEM-3 (Composite epoxy material-3). In the feeding board 21, a feeding board antenna feeding section 21*a* at the center, and a feeding board GND section 21*b* around the feeding board antenna feeding section 21*a*, which is insulated from the feeding board antenna feeding section 21*a*, are formed. In more detail, the feeding board antenna feeding section 21*a* faces the antenna contact point 13*a* and the feeding board GND section 21*b* faces the GND contact points 13*b* on a lower side of substantially the center of the feeding board 21. On the lower side of substantially the center of the feeding board 21, there are provided one through hole 21*c* in the feeding board antenna feeding section 21*a* and four through holes 21*c*, two on each of the right and left in the feeding board GND section 21*b*. The through holes 21*c* are provided corresponding to the through holes 11*b* in the film 11. On an upper side of substantially the center of the feeding board 21, a region for fastening the coaxial cable 30 is secured.

As shown in FIG. 2, in a region on the upper side of the feeding board 21, the coaxial cable 30 is soldered. In more detail, the feeding board antenna feeding section 21*a* provided at the center of the feeding board 21 and a core wire 31 of the coaxial cable 30 are joined by solder 41, and the feeding board GND section 21*b* on the feeding board 21 and an outer conductor 32 of the coaxial cable 30 are joined by solder 42. By soldering the coaxial cable 30 onto the feeding board 21 in advance and electrically connecting the contact point 13 of the antenna part 10 and the feeding board 21 by pressing thereafter like this, heat imparted to the soldering portion is not transmitted to the film 11 in the course of soldering. Therefore, even when a film with low heat resistance, for example, a resin film, is used as the film 11, the film 11 is not affected by heat generated in soldering.

Further, in the exemplary embodiment, of the contact point 13 formed in the projecting location 11*a* of the film 11 in the antenna part 10, at the location where the antenna contact point 13*a* and the GND contact points 13*b* are formed, a silver paste 22, which is a conductive paste, as one of conductive materials is subjected to formation processing. The silver paste 22 is provided to the side on which the contact point 13 is formed on the side of the projecting location 11*a* in the film 11 facing the feeding board 21 (on the backside in FIG. 2), and is applied to divided regions of a silver paste distribution section 22*a* and silver paste GND sections 22*b*. The silver paste 22 is applied to the contact point 13 by, for example, printing. By being coated with the silver paste 22, it becomes possible to increase conductivity between the contact point 13 and the feeding board 21.

Note that, in the exemplary embodiment, the silver paste 22 is provided as an example of the conductive material to be interposed; however, not being limited to the silver paste 22, any other material may be used as long as the material has high conductivity and a paste form.

[Manufacturing Method of Film Antenna 1]

Next, a manufacturing method of the film antenna 1 shown in FIG. 1 will be described by use of FIG. 2.

First, the core wire 31 of the coaxial cable 30 is aligned with the feeding board antenna feeding section 21*a* of the feeding board 21, and the outer conductor 32 of the coaxial cable 30 is aligned with the feeding board GND section 21*b* of the feeding board 21, to be joined by the solder 41 and 42; accordingly, the feeding board 21 and the coaxial cable 30 are connected.

Next, positions of the portion subjected to the processing by the silver paste 22 at the contact point 13 of the antenna part 10 and the contact point of the feeding board 21 are aligned. More specifically, the silver paste distribution section 22*a* and the feeding board antenna feeding section 21*a* of the feeding board 21 are aligned, the silver paste GND sections 22*b* and the feeding board GND section 21*b* of the feeding board 21 are aligned, and positions of the through holes 11*b* of the film 11 and the through holes 21*c* of the feeding board 21 are aligned.

Thereafter, the pressing member 23 is disposed on the side of the film 11 on which the contact point 13 is not formed, and the male screws (vises) 24 are penetrated into the through holes in the pressing member 23, the through holes 11*b* in the film 11 and the through holes 21*c* in the feeding board 21. Then, from the side of the feeding board 21 on which the feeding board antenna feeding section 21*a* and the feeding board GND section 21*b* are not formed (from the backside in FIG. 2), the female screws (nuts) 25 are placed and tighten the male screws (vises) 24. Consequently, the contact point 13 coated with the silver paste 22 is pressed by the feeding board 21 and the pressing member 23, and thereby the antenna contact point 13*a* and the feeding board antenna feeding section 21*a*, and the GND contact points 13*b* and the feeding board GND section 21*b* are electrically connected.

[Improvement Effect of PIM Characteristics by Film Antenna 1]

Next, description will be given of measurement results of improvement effects on intermodulation distortion (PIM) when the first exemplary embodiment is adopted.

Here, measurement of the PIM was performed in a case where the feeding part 20 of the exemplary embodiment was not adopted (hereinafter, abbreviated as "before taking measures") and in a case where the feeding part 20 of the exemplary embodiment was adopted (hereinafter, abbreviated as "after measures being taken"). As this "before taking measures", the antenna contact point 13*a* of the contact point 13 and the core wire 31 of the coaxial cable 30 are connected by the conductive adhesive, and the GND contact point 13*b* of the contact point 13 and the outer conductor 32 of the coaxial cable 30 are similarly connected by the conductive adhesive. As a prototype antenna, a dual-frequency antenna for the 800 MHz band and the 2.1 GHz band was used.

First, when each of signals of two waves, the 800 MHz band and the 2.1 GHz band, was transmitted at 1 W, the level of the seventh-order PIM appeared in the 800 MHz band was "−82 dBm" before taking measures and was "−129 dBm" after measures being taken; therefore, a distortion component of "47 dB" was improved. Moreover, the level of the nineteenth-order PIM appeared in the 2.1 GHz band was "−110 dBm" before taking measures and was "−135 dBm" after measures being taken; therefore, a distortion component of "25 dB" was improved. In this manner, it can be understood that, by adopting the exemplary embodiment, the PIM characteristics are improved, and thereby a more stable state can be obtained.

Second Exemplary Embodiment

Figure 3A:
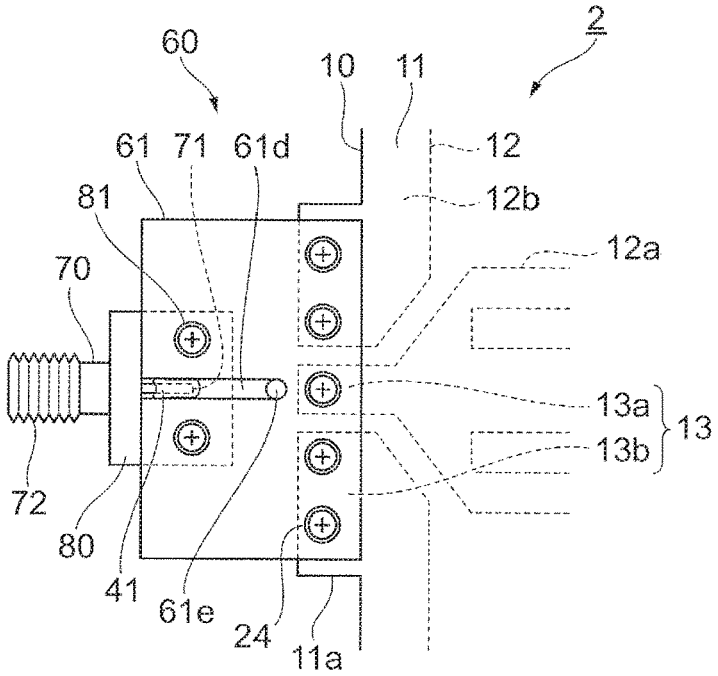
FIGS. 3A to 3C are diagrams showing a configuration of a film antenna to which the second exemplary embodiment is applied.
Figure 3B:
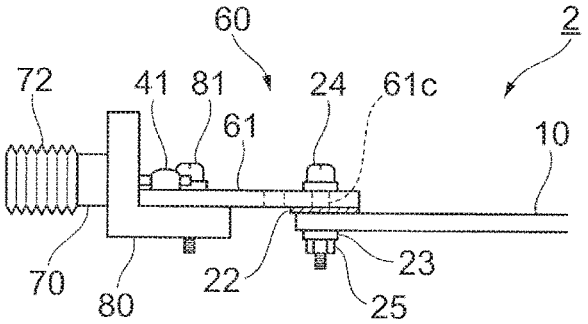
Figure 3C:
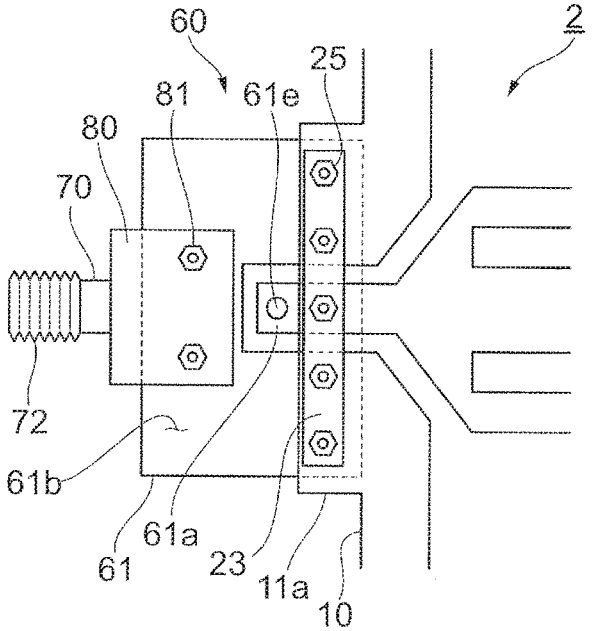

FIGS. 3A to 3C are diagrams showing a configuration of a film antenna 2 to which the second exemplary embodiment is applied. FIG. 3B is a diagram viewing the film antenna 2 from a direction, FIG. 3A is a diagram viewing FIG. 3B from above, and FIG. 3C is a diagram viewing FIG. 3B from below. The film antenna 2 is different from the film antenna 1, which is the first exemplary embodiment, in the point that a connector 70 is connected in place of the coaxial cable 30. Due to such a difference, there is provided a feeding part 60 in place of the feeding part 20 of the first exemplary embodiment. Note that, for functions similar to those in the first exemplary embodiment, same reference signs are used, and detailed descriptions thereof will be omitted here.

The film antenna 2 to which the second exemplary embodiment is applied also functions as one of the flexible printed circuit board structures, and includes the feeding part 60 to which the connector 70 for feeding the antenna part 10 is connected.

As shown in FIGS. 3A to 3C, the feeding part 60 includes a feeding board 61 to which the connector 70 is connected, and the contact point 13 of the antenna part 10 is pressed by the feeding board 61 and the pressing member 23. Moreover, the feeding part 60 is provided with the male screws (vises) 24 and the female screws (nuts) 25. The contact point 13 is formed, in the projecting location 11*a* of the film 11, on a surface on the side facing the feeding board 61. The structure of the contact point 13 is the same as that of the first exemplary embodiment. Moreover, the pressing member 23, the male screws (vises) 24 and the female screws (nuts) 25 are also the same as those of the first exemplary embodiment.

The feeding board 61 is configured with a microstrip line with impedance, for example, of the order of 50Ω, on an upper surface (front surface) of which a transmission line 61*d* for feeding is provided and on a lower surface (back surface) of which a conductor is provided, to thereby form a feeding board antenna feeding section 61*a* and a feeding board GND section 61*b*. The feeding board GND section 61*b* and the feeding board antenna feeding section 61*a*, which are the conductor on the lower surface, are insulated. The transmission line 61*d* on the upper surface of the feeding board 61 and the feeding board antenna feeding section 61*a* on the lower surface thereof are connected via a through hole 61*e*.

At one end of the feeding board 61, which is on the right side in the illustration in each of FIGS. 3A to 3C, the feeding board antenna feeding section 61*a* and the feeding board GND section 61*b* of the feeding board 61 face the contact point 13 of the film 11. Then, in the feeding board antenna feeding section 61*a* and the feeding board GND section 61*b* facing the contact point 13, there are provided through holes 61*c* corresponding to the through holes (not shown here) in the film 11. In more detail, there are provided one through hole 61*c* in the feeding board antenna feeding section 61*a* and four through holes 61*c*, two on each of the right and left in the feeding board GND section 61*b*.

As the connector 70 used in the film antenna 2, for example, a screw type male connector or the like can be adopted, and the connector 70 includes a screw portion 72 on one end side thereof, and is connected to an external cable (not shown) via the screw portion 72. Moreover, the other end of the connector 70 is connected to a conductive plate 80. The screw portion 72 and the conductive plate 80 of the connector 70 function as a GND line. In the conductive plate 80, a surface to have conduction or entirety is composed of a material having high conductivity, such as copper, and in the example shown in FIGS. 3A to 3C, the conductive plate 80 has an L shape. Then, the conductive plate 80 is connected to the connector 70 with a riser portion thereof in the vertical direction in FIG. 3B, and, with an inner side of the L shape in the horizontal direction, connected to the feeding board GND section 61*b* of the feeding board 61. The conductive plate 80 and the feeding board GND section 61*b* are fastened by screws 81.

From the connector 70, a signal line 71 is extracted, and the signal line 71 is joined to the transmission line 61*d* on the upper surface of the feeding board 61 by the solder 41. By assembling the antenna part 10 after feeding the feeding board 61 by soldering, even when a film with low heat resistance, for example, a resin film, is used as the film 11, the film 11 is not affected by heat generated in soldering.

Further, in the exemplary embodiment, at the contact point 13 formed in the projecting location 11*a* of the film 11 in the antenna part 10, the silver paste 22, which is one of conductive materials, is subjected to formation processing. The silver paste 22 is applied to the side on which the contact point 13 is formed on the side of the projecting location 11*a* in the film 11 facing the feeding board 21, for example, by printing. Though illustration is omitted in FIGS. 3A to 3C, the region is divided into structures similar to the silver paste distribution section 22*a* and the silver paste GND section 22*b*, respectively, which were described by use of FIG. 2. The feeding board 61 and the pressing member 23 are pressed by use of the male screws (vises) 24 and the female screws (nuts) 25, to thereby electrically connect the contact point 13 and the feeding board 61 via the silver paste 22.

[Manufacturing Method of Film Antenna 2]

Next, a manufacturing method of the film antenna 2 shown in FIGS. 3A to 3C will be described.

First, GNDs of the conductive plate 80 and the connector 70 are joined by, for example, screw-in, corresponding to the structure of the connector 70. Moreover, the signal line 71 of the connector 70 is projected to the inside of the L-shaped structure of the conductive plate 80 in the state of being insulated from the conductive plate 80. Then, after aligning the conductive plate 80 and the feeding board GND section 61*b* of the feeding board 61, the feeding board 61 and the conductive plate 80 are fastened by the screws 81, to thereby electrically connect the feeding board GND section 61*b* and the conductive plate 80. Moreover, the signal line 71 of the connector 70 and the transmission line 61*d* of the feeding board 61 are aligned and subjected to soldering, to electrically connect them by the solder 41.

Subsequently, positions of the portion subjected to the processing by the silver paste 22 at the contact point 13 of the antenna part 10 and the contact point of the feeding board 61 are aligned. Thereafter, the pressing member 23 is disposed on the side of the film 11 on which the contact point 13 is not formed to be pressed and fastened by the male screws (vises) 24 and the female screws (nuts) 25, and thereby the antenna contact point 13*a* and the feeding board antenna feeding section 61*a*, and the GND contact point 13*b* and the feeding board GND section 61*b* are electrically connected.

[Application as Indoor Partition Wall]

Next, description will be given of an application example of the film antenna to which the exemplary embodiments are applied.

Figure 4:
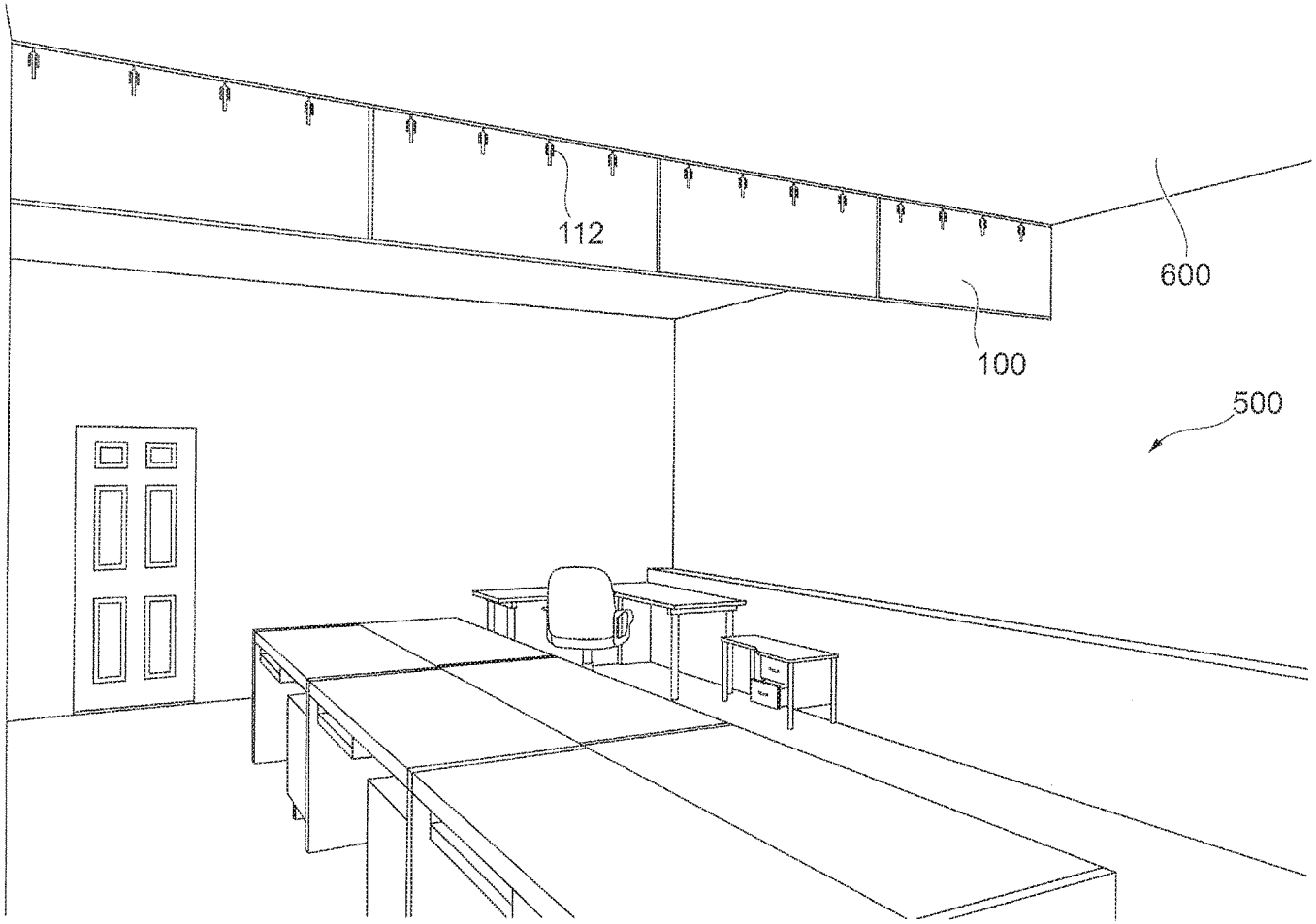
FIG. 4 is a diagram showing an exemplary embodiment that applies the film antenna of the first exemplary embodiment or the second exemplary embodiment to a vertical smokeproof wall as one of indoor partition walls.

FIG. 4 is a diagram showing an exemplary embodiment that applies the film antenna 1 of the first exemplary embodiment or the film antenna 2 of the second exemplary embodiment to a vertical smokeproof wall 100 as one of indoor partition walls. As the indoor partition wall, other than the vertical smokeproof wall 100 shown in FIG. 4, the film antenna can be applied to, for example, a partition plate or the like.

Conventionally, for installing an antenna indoors, a ceiling-mounted or ceiling-concealed antenna was used (for example, refer to Japanese Patent Application Laid-Open Publication No. 9-238012). Here, in a multiple-input and multiple-output system (a MIMO system) combining multiple antennas to broaden bands for data transmission and reception, multiple antennas are required, and when the conventional ceiling-mounted or ceiling-concealed antennas were used, various kinds of problems, such as spoiling sights, losing flexibility in disposing or rise in installation costs, were caused.

In one of the inventions to which the exemplary embodiment is applied, an object is to provide an antenna device that makes installation works efficient without spoiling indoor sights.

In the exemplary embodiment shown in FIG. 4, in an office 500, the vertical smokeproof walls 100 for alleviating accidents caused by smoke in a fire are provided. In general, to prevent the smoke generated in fires from diffusing, the vertical smokeproof walls 100 are placed with a height in a vertically downward direction from a ceiling surface 600 and a length along the ceiling surface 600. On the other hand, in general, regarding an installation environment of the antennas, for transmitting and receiving signals in the entirety in the office 500, it is preferable to install the antennas at heights in the room. According to the exemplary embodiment, since the vertical smokeproof wall 100 is provided with the antenna function, it is possible to provide, together with the function of diffusing smoke, the antenna function while reducing the installation costs without spoiling sights.

Figure 5:
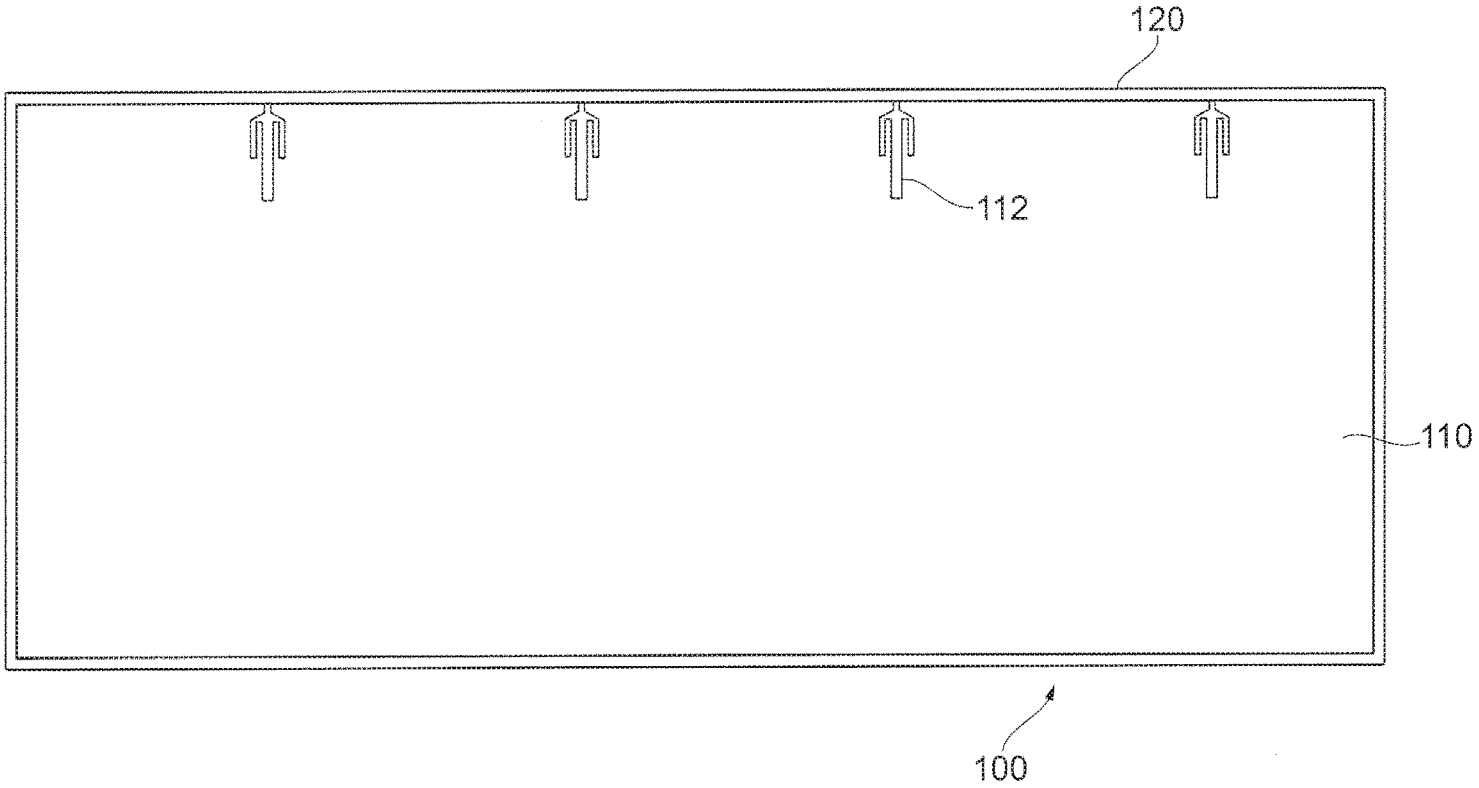
FIG. 5 is a diagram for illustrating an overall configuration of the vertical smokeproof wall.

FIG. 5 is a diagram for illustrating an overall configuration of the vertical smokeproof wall 100. Moreover, FIG. 6 is a diagram for illustrating a joint portion of the vertical smokeproof wall 100.

Figure 6:
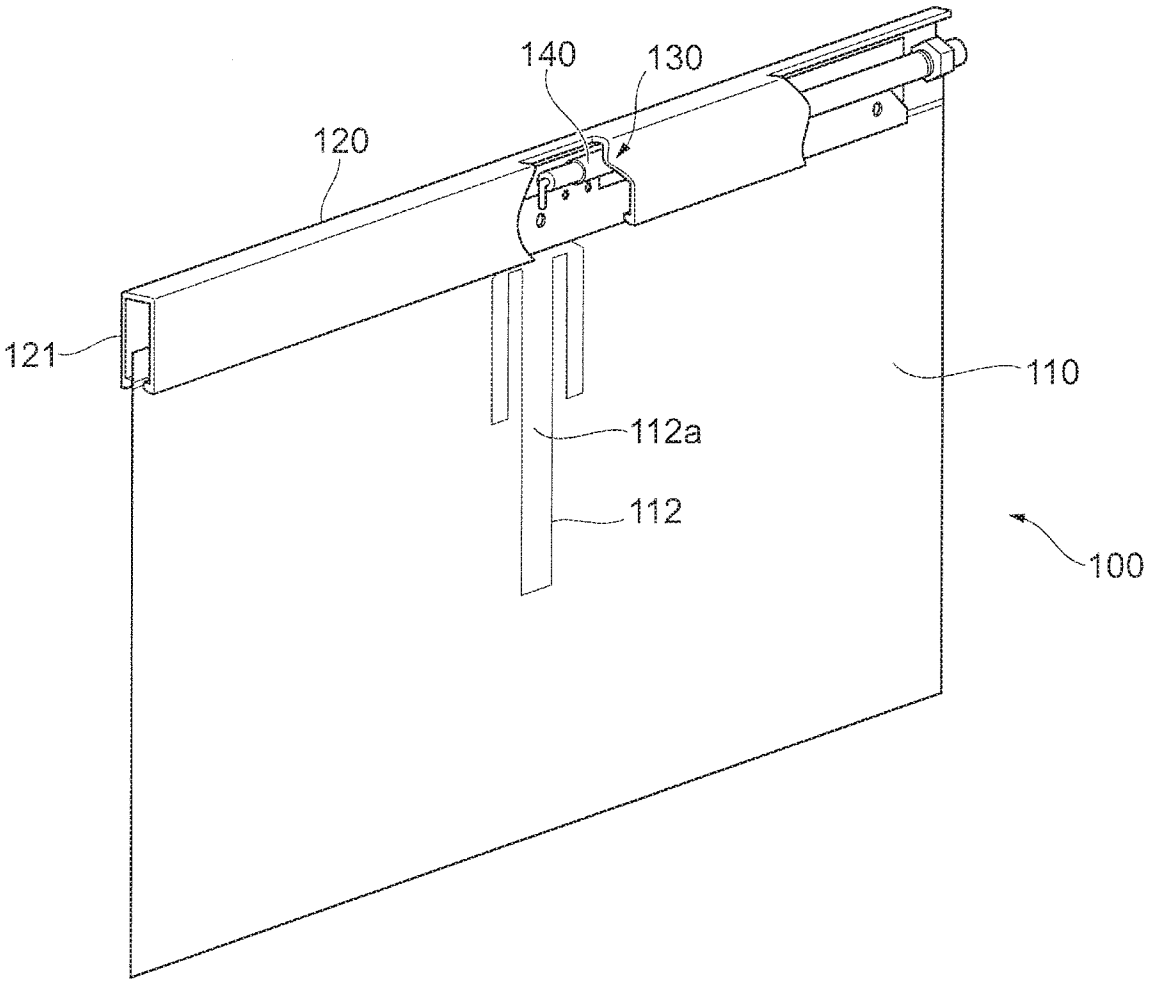
FIG. 6 is a diagram for illustrating a joint portion of the vertical smokeproof wall.

The vertical smokeproof wall 100 shown in FIGS. 5 and 6 adopts, as a partition material formed of a film material or a plate material to partition a space in a room, a film antenna 110 using a transparent film made of a resin having relatively high transmittance. In the film antenna 110, an antenna 112 using a transparent conductive material is formed. The antenna 112 includes a dual-frequency antenna 112*a* that uses two frequencies of, for example, the 800 MHz band and the 2.1 GHz band, and an antenna GND section (not shown) to be connected to the ground (GND). In the example shown in FIG. 5, plural (for example, four) antennas 112 are provided, and are extended from the ceiling surface 600 side in the downward direction as shown in FIG. 4.

There exist end portions 120 around the film antenna 110, which is the partition material, and as shown in FIG. 6, a covering member 121 is provided along the end portion 120. The antenna GND section (not shown) is formed at a position of the film antenna 110 hidden by the covering member 121. The covering member 121 is formed of a resin material or a metal material; however, there is provided a configuration in which the covering member 121 and the antenna GND section are insulated.

Inside the covering member 121, a feeding part 130, which has the same function and structure as the feeding part 20 or the feeding part 60 described in detail in FIGS. 1 to 3, is provided. A cable 140 is connected to the feeding part 130, and the cable 140 and the antenna 112 are electrically connected via the feeding part 130. Though the wiring structure and the like partially differ from the feeding part 20 or the feeding part 60, the feeding part 130 has substantially the same configuration. That is, the cable 140 and the feeding board (not shown) of the feeding part 60 are connected by, for example, soldering. Moreover, a conductive material (not shown) made of, for example, a silver paste is interposed between the contact point (not shown) of the antenna 112 and the feeding board and pressed by the pressing member (not shown), to thereby electrically connect the contact point of the antenna 112 and the feeding board. Detailed descriptions other than this are similar to those in FIGS. 1 to 3, and thereby omitted here.

Figure 7:
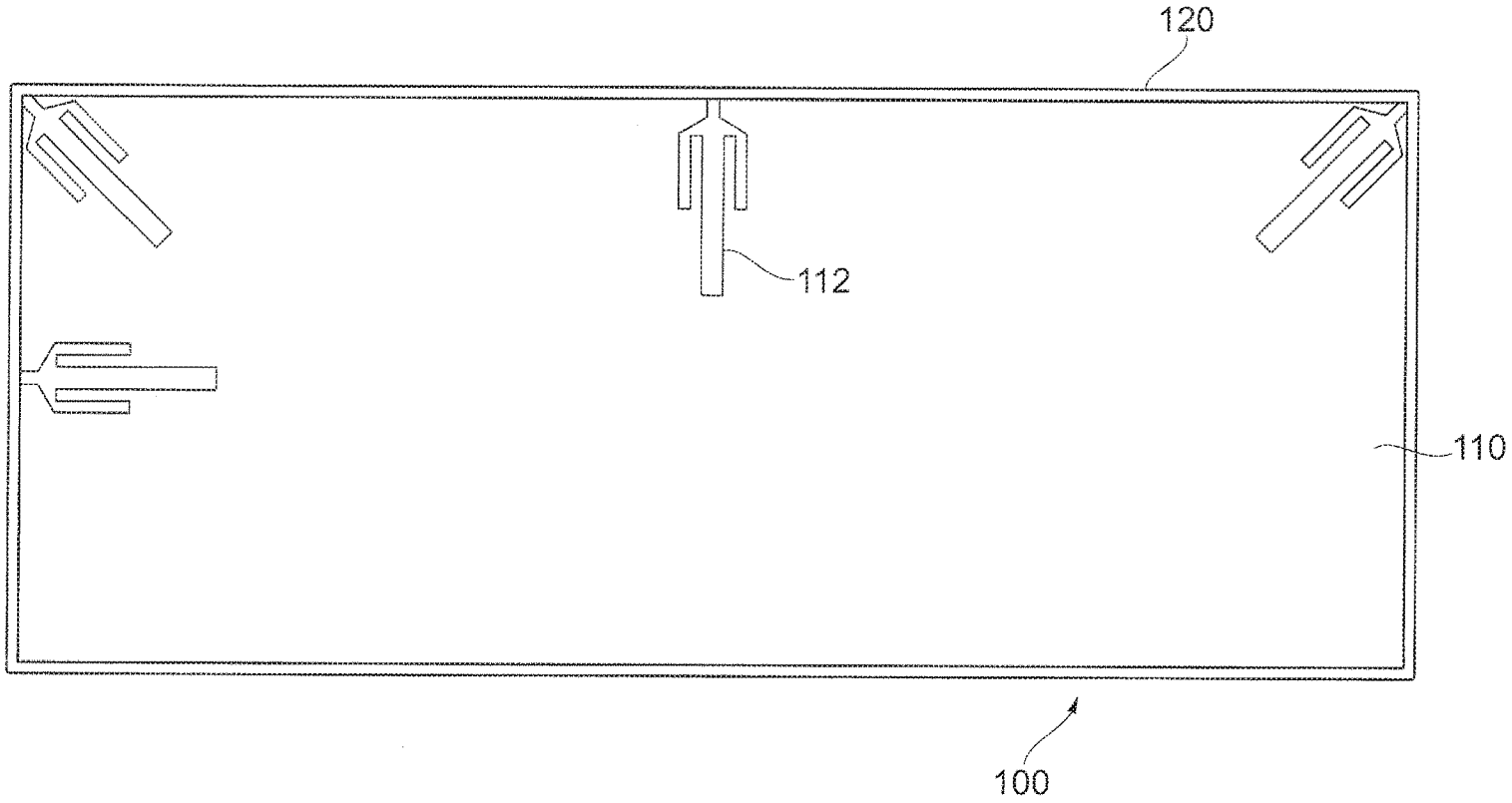
FIG. 7 is a diagram showing another example of the vertical smokeproof wall.
Figure 8:
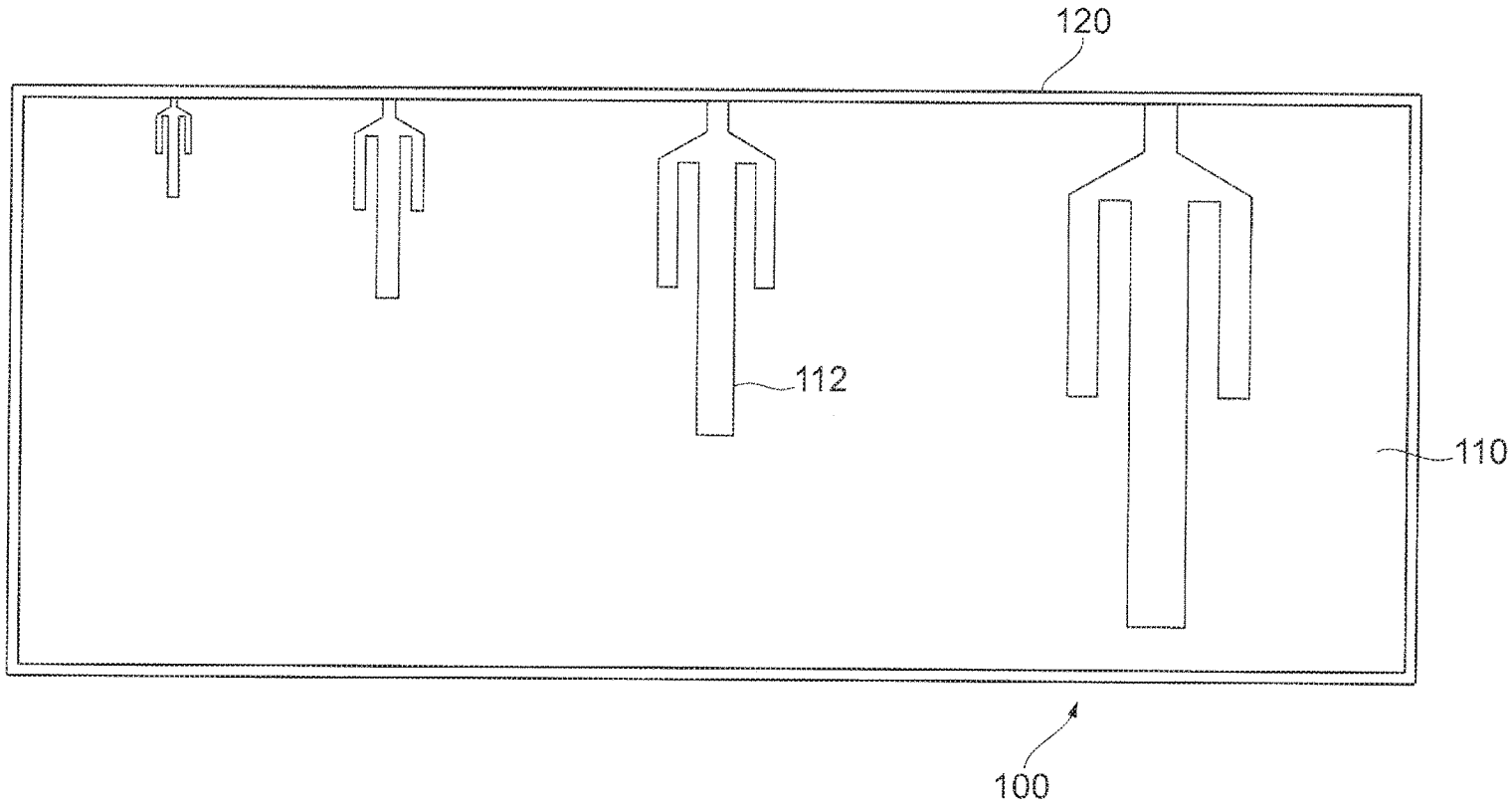
FIG. 8 is a diagram showing another example of the vertical smokeproof wall.

FIGS. 7 and 8 are diagrams showing other examples of the vertical smokeproof wall 100. The antennas 112 similar to the vertical smokeproof walls 100 shown in FIGS. 5 and 6 are provided; however, the example shown in FIG. 7 is capable of adapting to plural polarizations, and the example shown in FIG. 8 is capable of adapting to more frequency bands. In more detail, the example shown in FIG. 7 is adapted to, of the polarizations, a vertical polarization whose electric field surface is perpendicular to the ground, a horizontal polarization whose electric field surface is horizontal to the ground, and a +45-degree polarization and a −45-degree polarization whose polarization surface is shifted 45 degrees. Moreover, the example shown in FIG. 8 is adaptable to plural bands, such as the 700 MHz band, the 800 MHz band, the 1.5 GHz band, the 1.7 GHz band, the 2 GHz band, the 2.6 GHz band and the 3.5 GHz band. In general, since the surface area of the vertical smokeproof wall 100, as an in-room building structure, is comparatively large, applications shown in FIGS. 7 and 8 becomes available.

REFERENCE SIGNS LIST

1 . . . Film antenna
2 . . . Film antenna
10 . . . Antenna part
11 . . . Film
12 . . . Antenna
13 . . . Contact point
20 . . . Feeding part
21 . . . Feeding board
22 . . . Silver paste
23 . . . Pressing member
24 . . . Male screw (vis)
25 . . . Female screw (nut)
30 . . . Coaxial cable
31 . . . Core wire
32 . . . Outer conductor
41 . . . Solder
42 . . . Solder
60 . . . Feeding part
61 . . . Feeding board
70 . . . Connector
71 . . . Signal line
80 . . . Conductive plate
81 . . . Screw
100 . . . Vertical smokeproof wall
110 . . . Film antenna
112 . . . Antenna
120 . . . End portion
130 . . . Feeding part
140 . . . Cable

The invention claimed is:

1. A flexible printed circuit board structure comprising:

a flexible printed circuit board that includes a projection location projecting on an end portion of the flexible printed circuit board toward another portion and a high-frequency circuit formed on the flexible printed circuit board;

a feeding board to which a cable or a connector for feeding the flexible printed circuit board is connected; and a pressing member that sandwiches a contact point of the flexible printed circuit board and the feeding board together, and presses the contact point and the feeding board to electrically connect the contact point and the feeding board, wherein a through hole is formed at the contact point of the flexible printed circuit board, and the pressing member presses the contact point and the feeding board with a fastening tool by use of the through hole.

2. The flexible printed circuit board structure according to claim 1, wherein a conductive material is interposed between the contact point and the feeding board, the flexible printed circuit board is an antenna using a resin film, and the cable or the connector is connected to the feeding board by soldering.

3. A flexible printed circuit board structure comprising:

a flexible printed circuit board that includes a projecting location projecting on an end portion of the flexible printed circuit board toward another portion and a high-frequency circuit formed on the flexible printed circuit board;

a feeding board that includes an antenna feeding section to which a cable or a connector for feeding the flexible printed circuit board is connected and a ground section insulated from the antenna feeding section; and a pressing member that sandwiches an antenna contact point and a ground contact point as a contact point provided to the projecting location of the flexible printed circuit board together with the feeding board, presses the antenna contact point and the antenna feeding section of the feeding board with a fastening tool, and presses the ground contact point and the ground section of the feeding board with another fastening tool to attain electrical connection.

4. The flexible printed circuit board structure according to claim 3, wherein a conductive material is interposed between the contact point and the feeding board, the flexible printed circuit board is an antenna using a resin film, and the cable or the connector is connected to the feeding board by soldering.

5. An indoor partition wall comprising:

a partition material that includes a projecting location projecting on an end portion of the partition material toward another portion and that is formed of a film material or a plate material to partition a space in a room;

an antenna that is formed on one or both surfaces of the partition material and connected to the projecting location of the partition material; and a feeding part that is provided along the end portion of the partition material, to which a cable or a connector for feeding the antenna is connected, wherein the feeding part includes a feeding board to which the cable or the connector is connected and a pressing member that presses a contact point provided to the projecting location of the partition material and the feeding board to electrically connect the contact point of the antenna and the feeding board, a through hole is formed at the contact point of the antenna, and the pressing member sandwiches the contact point and the feeding board together by use of the through hole and presses the contact point and the feeding board with a fastening tool.

6. An indoor partition wall comprising:

a partition material that includes a projecting location projecting on an end portion of the partition material toward another portion, the partition material being formed of a film material or a plate material to partition a space in a room;

an antenna that is formed on one or both surfaces of the partition material and is connected to the projecting location of the partition material; and a feeding part that is provided along the projecting location of the partition material and includes an antenna feeding section for feeding the antenna, to which a cable or a connector is connected, and a ground section insulated from the antenna feeding section, wherein an antenna contact point and a ground contact point provided to the projecting location of the partition material are sandwiched together with the feeding part by a pressing member, the antenna contact point and the antenna feeding section of the feeding part are pressed with a fastening tool, and the ground contact point and the ground section of the feeding part are pressed with another fastening tool to attain electrical connection.

* * * * *